US007637823B2

(12) United States Patent
Shimazaki et al.

(10) Patent No.: US 7,637,823 B2
(45) Date of Patent: Dec. 29, 2009

(54) GOLF CLUB HEAD

(75) Inventors: Hideo Shimazaki, Tokyo (JP); Hideo Matsunaga, Saitama (JP); Wataru Ban, Saitama (JP)

(73) Assignee: Bridgestone Sports Co., Ltd, Tokyo (JP)

( * ) Notice: Subject to any disclaimer, the term of this patent is extended or adjusted under 35 U.S.C. 154(b) by 111 days.

(21) Appl. No.: 11/474,419

(22) Filed: Jun. 26, 2006

(65) Prior Publication Data

US 2007/0129164 A1 Jun. 7, 2007

(30) Foreign Application Priority Data

Dec. 5, 2005 (JP) ..... 2005-351283

(51) Int. Cl.
*A63B 53/04* (2006.01)
*A63B 53/06* (2006.01)

(52) U.S. Cl. ..... 473/332; 473/335; 473/345; 473/350

(58) Field of Classification Search ..... 473/324–350
See application file for complete search history.

(56) References Cited

U.S. PATENT DOCUMENTS 2,846,228 A 8/1958 Reach
3,084,940 A 4/1963 Cissel
4,804,188 A 2/1989 McKee et al.
4,811,950 A 3/1989 Kobayashi
4,928,972 A 5/1990 Nakanishi et al.
5,290,036 A 3/1994 Fenton et al.
5,299,807 A 4/1994 Hutin
5,316,298 A 5/1994 Hutin et al.
5,316,305 A * 5/1994 McCabe ..... 473/332
5,351,958 A 10/1994 Helmstetter
5,362,055 A 11/1994 Rennie
5,409,229 A 4/1995 Schmidt et al.
5,411,255 A 5/1995 Kurashima et al.
5,431,396 A 7/1995 Shieh
5,492,327 A * 2/1996 Biafore, Jr. ..... 473/332
5,529,543 A 6/1996 Beaumont, Sr.
5,564,705 A 10/1996 Kbbayashi et al.
5,586,947 A 12/1996 Hutin
5,643,111 A 7/1997 Igarashi
5,692,972 A 12/1997 Langslet
5,697,855 A 12/1997 Aizawa
5,703,294 A 12/1997 McConnell et al.

(Continued)

FOREIGN PATENT DOCUMENTS

EP 1757334 A1 2/2007

(Continued)

*Primary Examiner*—Alvin A Hunter
(74) *Attorney, Agent, or Firm*—Sughrue Mion, PLLC

(57) ABSTRACT

This invention provides a hollow golf club head including a fixing member which includes a shaft body formed with a threaded portion at one end, and a head portion at the other end of the shaft body, a viscoelastic body having an opening through which the shaft body extends, a recess portion formed in a circumferential wall of the golf club head and in which the viscoelastic body is disposed, and a screw hole formed in a bottom portion of the recess portion and threadably engages with the threaded portion. The viscoelastic body is fixed between the head portion and the bottom portion by threadably engaging the threaded portion with the screw hole.

20 Claims, 3 Drawing Sheets

U.S. PATENT DOCUMENTS

| | | | | |
|---|---|---|---|---|
| 5,766,092 | A | 6/1998 | Mimeur et al. | |
| 5,766,093 | A | 6/1998 | Rohrer | |
| 6,045,456 | A | 4/2000 | Best et al. | |
| 6,093,116 | A | 7/2000 | Hettinger et al. | |
| 6,265,475 | B1 | 7/2001 | Chifei et al. | |
| 6,302,807 | B1 | 10/2001 | Rohrer | |
| 6,431,997 | B1 | 8/2002 | Rohrer | |
| 6,616,546 | B2 | 9/2003 | Cho | |
| 6,642,308 | B2 | 11/2003 | Nomura et al. | |
| 6,672,975 | B1 * | 1/2004 | Galloway | 473/342 |
| 6,688,989 | B2 | 2/2004 | Best | |
| 6,743,114 | B2 | 6/2004 | Best | |
| 6,743,117 | B2 | 6/2004 | Gilbert | |
| 6,773,360 | B2 * | 8/2004 | Willett et al. | 473/334 |
| 6,780,123 | B2 | 8/2004 | Hasebe | |
| 6,835,144 | B2 | 12/2004 | Best | |
| 6,855,066 | B2 | 2/2005 | Best | |
| 6,902,495 | B2 | 6/2005 | Pergande et al. | |
| 6,984,180 | B2 | 1/2006 | Hasebe | |
| 6,991,559 | B2 | 1/2006 | Yabu | |
| 6,991,560 | B2 | 1/2006 | Tseng | |
| 7,048,647 | B2 * | 5/2006 | Burrows | 473/334 |
| 7,108,613 | B1 * | 9/2006 | Gordon et al. | 473/341 |
| 7,119,146 | B2 | 10/2006 | Tse et al. | |
| 7,182,698 | B2 | 2/2007 | Tseng | |
| 7,189,169 | B2 * | 3/2007 | Billings | 473/332 |
| 7,207,899 | B2 | 4/2007 | Imamoto | |
| 7,226,366 | B2 * | 6/2007 | Galloway | 473/342 |
| 7,303,485 | B2 | 12/2007 | Tseng | |
| 7,303,486 | B2 | 12/2007 | Imamoto | |
| 7,316,623 | B2 | 1/2008 | Imamoto | |
| 7,371,190 | B2 | 5/2008 | Gilbert et al. | |
| 2003/0027662 | A1 * | 2/2003 | Werner et al. | 473/346 |
| 2003/0092502 | A1 | 5/2003 | Pergande et al. | |
| 2004/0043830 | A1 | 3/2004 | Imamoto | |
| 2004/0053704 | A1 | 3/2004 | Gilbert | |
| 2004/0242339 | A1 | 12/2004 | Gilbert et al. | |
| 2005/0124437 | A1 | 6/2005 | Imamoto | |
| 2005/0148405 | A1 | 7/2005 | Imamoto | |
| 2005/0192116 | A1 | 9/2005 | Imamoto | |
| 2005/0197208 | A1 | 9/2005 | Imamoto | |
| 2006/0258480 | A1 | 11/2006 | Hou et al. | |
| 2007/0049400 | A1 * | 3/2007 | Imamoto et al. | 473/329 |
| 2007/0129160 | A1 * | 6/2007 | Matsunaga et al. | 473/332 |
| 2007/0129161 | A1 * | 6/2007 | Matsunaga et al. | 473/332 |
| 2007/0129162 | A1 | 6/2007 | Pan et al. | |
| 2007/0129164 | A1 * | 6/2007 | Shimazaki et al. | 473/338 |
| 2007/0129165 | A1 * | 6/2007 | Matsunaga et al. | 473/345 |
| 2007/0129166 | A1 * | 6/2007 | Shimazaki et al. | 473/345 |
| 2007/0129168 | A1 * | 6/2007 | Matsunaga et al. | 473/349 |
| 2007/0149313 | A1 * | 6/2007 | Matsunaga et al. | 473/332 |
| 2008/0020860 | A1 | 1/2008 | Imamoto | |

FOREIGN PATENT DOCUMENTS

| | | | | |
|---|---|---|---|---|
| FR | 2717701 | A1 | * | 9/1995 |
| JP | 01-166779 | A | | 6/1989 |
| JP | 05-028361 | U | | 4/1993 |
| JP | 05147096 | A | | 6/1993 |
| JP | 06-007486 | A | | 1/1994 |
| JP | 06254183 | A | | 9/1994 |
| JP | 06-319836 | A | | 11/1994 |
| JP | 07-27630 | U | | 5/1995 |
| JP | 07-148291 | A | | 6/1995 |
| JP | 07-213656 | A | | 8/1995 |
| JP | 08-206258 | A | | 8/1996 |
| JP | 09-000666 | A | | 1/1997 |
| JP | 09-122281 | A | | 5/1997 |
| JP | 11114112 | A | * | 4/1999 |
| JP | 2000-116824 | A | | 4/2000 |
| JP | 2000197718 | A | * | 7/2000 |
| JP | 2001000606 | A | * | 1/2001 |
| JP | 2001-170225 | A | | 6/2001 |
| JP | 2004-313777 | A | | 11/2001 |
| JP | 2003-093550 | A | | 4/2003 |
| JP | 2003-102877 | A | | 4/2003 |
| JP | 2003-250939 | A | | 9/2003 |
| JP | 2003-265652 | A | | 9/2003 |
| JP | 2003-265653 | A | | 9/2003 |
| JP | 2003260153 | A | * | 9/2003 |
| JP | 2004-089434 | A | | 3/2004 |
| JP | 2005-006763 | A | | 1/2005 |
| JP | 2005-160947 | A | | 6/2005 |
| JP | 2005-160948 | A | | 6/2005 |
| JP | 3112038 | U | | 6/2005 |
| JP | 2005-218510 | A | | 8/2005 |
| JP | 2005-245519 | A | | 9/2005 |
| JP | 2006000139 | A | * | 1/2006 |
| JP | 2006000435 | A | | 1/2006 |
| WO | 9920358 | A1 | | 4/1999 |

* cited by examiner

GOLF CLUB HEAD

FIELD OF THE INVENTION

The present invention relates to a golf club head and, more particularly, to a fixing structure of a viscoelastic body to a hollow golf club head.

BACKGROUND OF THE INVENTION

In a wood type golf club head represented by a driver or fairway wood, the golf club head has been formed to have a hollow structure to increase its volume in order to enlarge the so-called sweet spot. In addition, a hollow golf club head fixed with a viscoelastic body on a part of its circumferential wall, e.g., in a sole portion, to improve the hitting impression or adjust the hitting sound on impact has been prevailed. When the viscoelastic body is fixed, the vibration on impact is absorbed by the viscoelastic body to improve the hitting impression and decrease the hitting sound that is offensive to the player's ear.

As a fixing structure to fix a viscoelastic body to a hollow golf club head, for example, a structure disclosed in Japanese Patent Laid-Open No. 2005-160947 has been proposed. In Japanese Patent Laid-Open No. 2005-160947, the following fixing structure is disclosed. A recess portion is formed in a part of the circumferential wall of a golf club head and a viscoelastic body is inserted in the recess portion. The inner circumferential wall of the recess portion forms a screw hole. When a threaded portion is threadably engaged with the screw hole, the viscoelastic body is sandwiched between the distal end of the threaded portion and the bottom portion of the recess portion.

In order to more effectively damp vibration on impact by the viscoelastic body, the viscoelastic body is desirably as close to the circumferential wall of the golf club head as possible. When the viscoelastic body is fixed in the sole portion, the viscoelastic body is desirably fixed to the lowest position to lower the center of gravity of the golf club head. In the fixing structure disclosed in Japanese Patent Laid-Open No. 2005-160947, a viscoelastic is sandwiched between the distal end of the threaded portion and the bottom portion of the recess portion. With this structure, the viscoelastic body is away from the circumferential wall by the length of the threaded portion. Therefore, this structure still has room for improvement in terms of increasing the vibration damping effect of the viscoelastic body. In the fixing structure disclosed in Japanese Patent Laid-Open No. 2005-160947, the viscoelastic body positions at a point higher than the circumferential wall of the sole portion by the length of the threaded portion. Therefore, this structure still has room for improvement in terms of lowering the center of gravity.

SUMMARY OF THE INVENTION

The present invention has been made in order to overcome the deficits of prior art.

According to the aspects of the present invention, there is provided a hollow golf club head comprising a fixing member having a shaft body formed with a threaded portion at one end, and a head portion at the other end of the shaft body, a viscoelastic body having an opening through which the shaft body extends, a recess portion formed in a circumferential wall of the golf club head and in which the viscoelastic body is disposed, and a screw hole formed in a bottom portion of the recess portion and threadably engages with the threaded portion, wherein the viscoelastic body is fixed between the head portion and the bottom portion by threadably engaging the threaded portion with the screw hole.

In the golf club head, as the viscoelastic body forms a structure where the shaft body of the fixing member extends through the viscoelastic body, the depth of the recess portion can be shallower, so that the viscoelastic body can be fixed at a position closer to the circumferential wall. Hence, the vibration damping effect of the viscoelastic body can be improved.

Other features and advantages of the present invention will be apparent from the following descriptions taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENTS

Preferred embodiments of the present invention will now be described in detail in accordance with the accompanying drawings.

Figure 1:
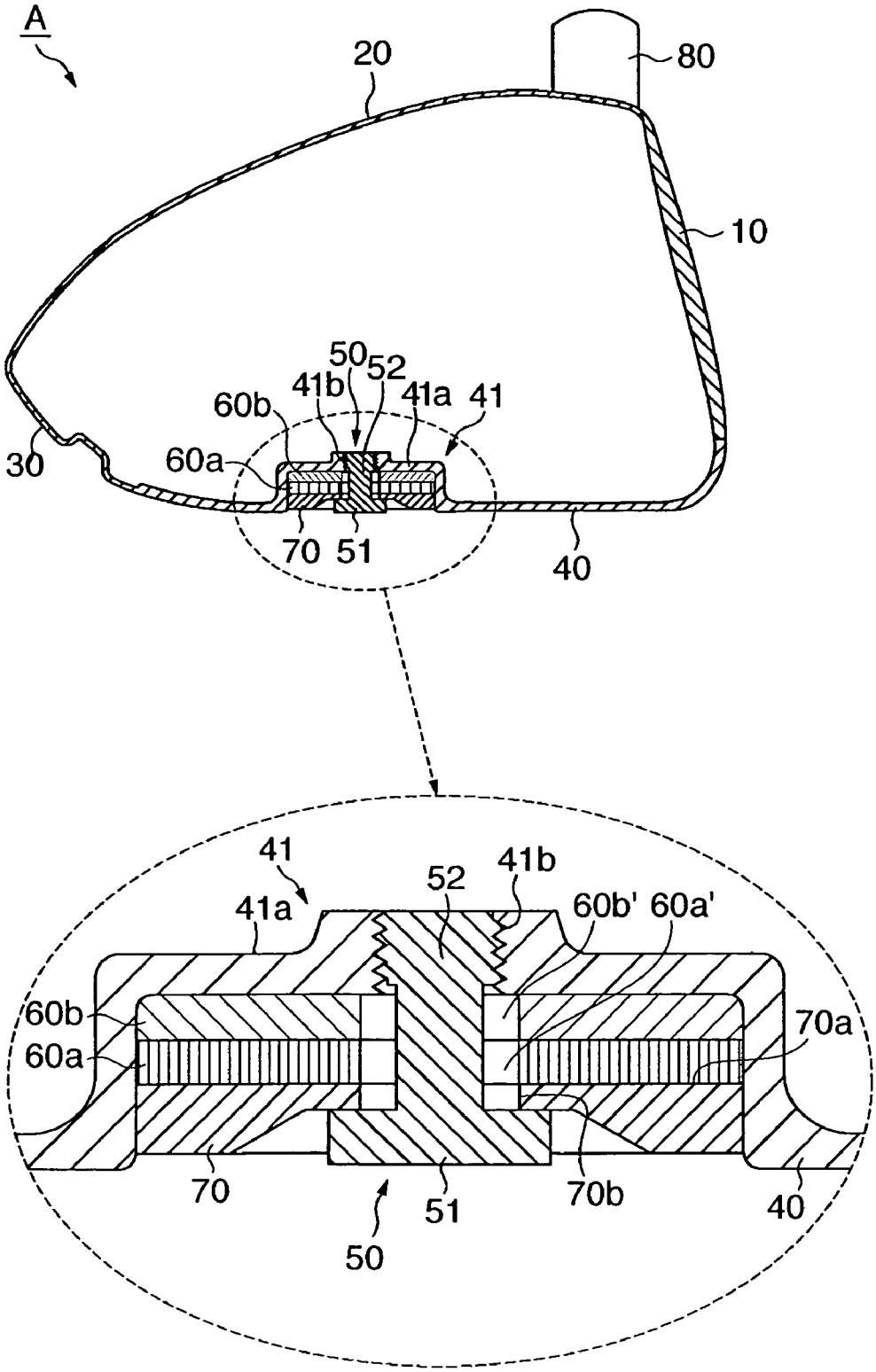
FIG. 1 includes a sectional view showing the structure of a golf club head A according to an embodiment of the present invention, and an enlarged view of the main part of the same.

FIG. 1 includes a sectional view showing the structure of a golf club head A according to an embodiment of the present invention, and an enlarged view of the main part of the same. The golf club head A forms a hollow body, and its circumferential wall constitutes a face portion 10 which forms a golf ball hitting surface, a crown portion 20 which forms the upper surface of the golf club head A, a side portion 30 (only the back side is shown) which forms the toe-side, heel-side, and back-side side surfaces of the golf club head A, and a sole portion 40 which forms the bottom surface of the golf club head A. The golf club head A is also provided with a hosel portion 80 to which a shaft is to be fixed. The golf club head A is desirably made of, e.g., a titanium-based metal material.

Although the golf club head A is a golf club head that is to be used as a driver, the present invention can be applied to a wood type golf club head including a fairway wood or the like other than the driver as well, a utility type golf club head, and other hollow golf club heads.

A recess portion 41 extending into the golf club head A is integrally formed in the sole portion 40, and viscoelastic bodies 60*a* and 60*b* are disposed in the recess portion 41. Although the outline of the side wall of the recess portion 41 forms a circle in this embodiment, the shape of the recess portion 41 is not limited to this, but the outline of the side wall of the recess portion 41 can form an ellipse or a shape having corners. A screw hole 41*b* is formed in a bottom portion 41*a* of the recess portion 41. The screw hole 41*b* is located substantially at the center of the bottom portion 41*a*.

Figure 2:
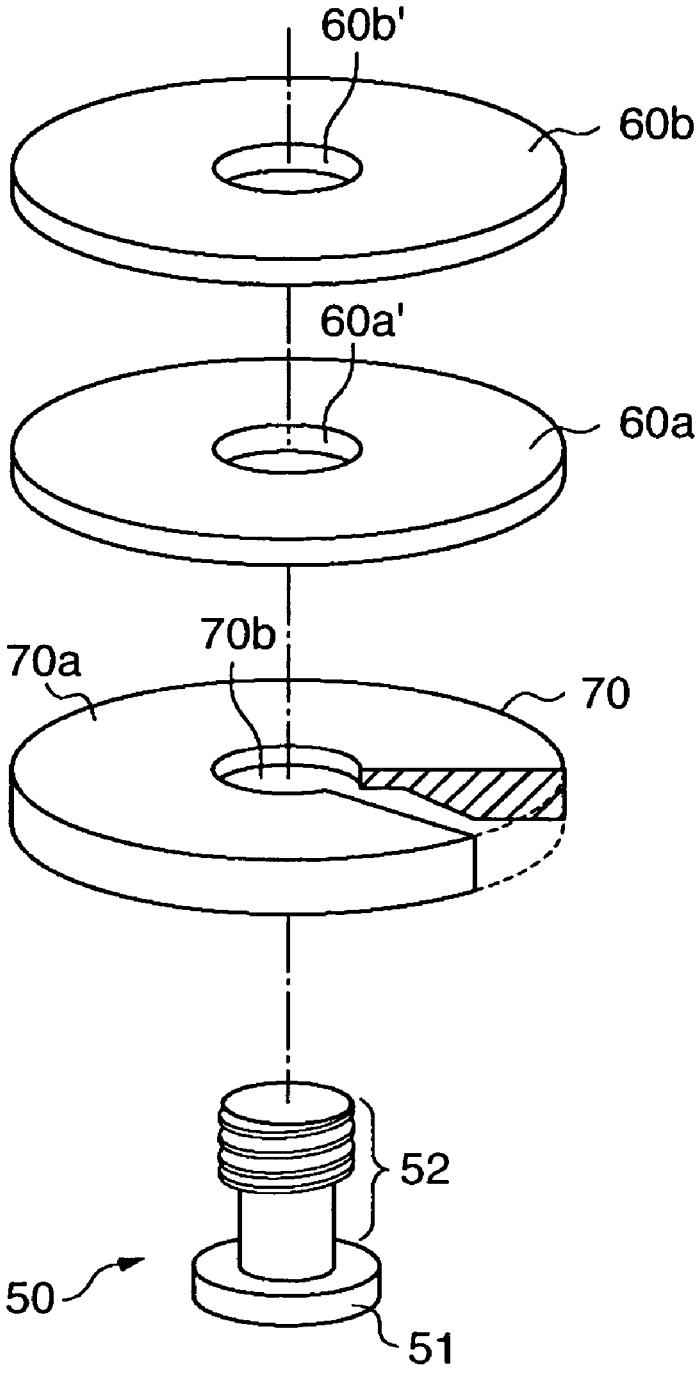
FIG. 2 is an exploded perspective view of the fixing structure of viscoelastic bodies.

A fixing member 50 threadably engages with a screw hole 41*b*. The fixing member 50 and an interposed member 70 fix the viscoelastic bodies 60*a* and 60*b*. FIG. 2 is an exploded perspective view of the fixing structure of the viscoelastic bodies, showing the viscoelastic bodies 60*a* and 60*b*, interposed member 70, and fixing member 50. In FIG. 2, the interposed member 70 is partially cutaway.

The fixing member 50 has a shaft body 52 formed with a threaded portion at its one end to threadably engage with the screw hole 41*b*, and a head portion 51 integrally connected to the other end of the shaft body 52. Both the viscoelastic bodies 60*a* and 60*b* form circular flat plates, and openings 60*a*' and 60*b*' where the shaft body 52 is to extend are formed at the central portions of the viscoelastic bodies 60*a* and 60*b*. Although the openings 60*a*' and 60*b*' are circular through holes, the present invention is not limited to this, and, e.g., a notch 60*c*' may be formed as in a viscoelastic body 60*c* shown in FIG. 3B. Although the viscoelastic bodies 60*a*, 60*b*, and 60*c* are circular, their shapes can be elliptic or have corners.

The viscoelastic bodies 60*a* and 60*b* are made of viscoelastic materials such as NBR (acrylonitrile-butadiene rubber), and the like. The viscoelastic bodies 60*a* and 60*b* can also be formed by mixing a metal powder or the like in the viscoelastic materials described above to adjust their specific gravities. According to this embodiment, the two viscoelastic bodies 60*a* and 60*b* are mounted in the recess portion 41 in a stacked manner. However, naturally, a single viscoelastic body can be mounted.

The vibration of a golf club head on impact ranges in a variety of frequencies. The frequency band in which a viscoelastic material effectively absorbs vibration is limited to a certain range in accordance with the viscoelastic material. Therefore, the two viscoelastic bodies 60*a* and 60*b* desirably have vibration damping performances different from each other. With this structure, the vibration damping effect can be improved with respect to the vibration in a wider frequency band. For example, the viscoelastic bodies 60*a* and 60*b* can be made of viscoelastic materials with loss coefficients (so-called tan δ) temperature dependences of which are different. When the temperature dependence of a loss coefficient changes, the frequency band in which vibration is effectively absorbed also changes.

The interposed member 70 is a member interposed between the viscoelastic bodies 60*a* and 60*b* and the head portion 51 of the fixing member 50, and serves to press the viscoelastic bodies 60*a* and 60*b* against the bottom portion 41*a* of the recess portion 41 substantially evenly. The interposed member 70 has a flat surface 70*a* with the same shape as the outer shape of each of the viscoelastic bodies 60*a* and 60*b*, and an opening 70*b* where the shaft body 52 is to extend is formed at the center of the interposed member 70. Although the opening 70*b* is a circular through hole, the present invention is not limited to this, and the opening 70*b* can be a notch in the same manner as in the viscoelastic body (FIG. 3B). The central portion of the interposed member 70 is thinner-walled than its circumferential portion. Thus, when the fixing member 50 is fixed to the recess portion 41, the head portion 51 of the fixing member 50 is partly buried in the interposed member 70.

In the golf club head A having the above structure, the shaft body 52 of the fixing member 50 is inserted in the openings 70*b*, 60*a*', and 60*b*' of the interposed member 70 and viscoelastic bodies 60*a* and 60*b*, and the threaded portion at the distal end of the shaft body 52 is threadably engaged with the screw hole 41*b*. Thus, the viscoelastic bodies 60*a* and 60*b* are fixed as they are sandwiched between the head portion 51 and bottom portion 41*a*. As the viscoelastic bodies 60*a* and 60*b* form a structure through which the shaft body 52 of the fixing member 50 extends, the depth of the recess portion 41 can be made shallower, so that the viscoelastic bodies 60*a* and 60*b* can be fixed at a position closer to the circumferential wall (sole portion 40).

Accordingly, the vibration damping effect of the viscoelastic bodies 60*a* and 60*b* can improve. In addition, since the viscoelastic bodies 60*a* and 60*b* are fixed close to the sole portion 40 in this embodiment, the center of gravity can be lowered. According to this embodiment, since the interposed member 70 is interposed between the head portion 51 and the viscoelastic bodies 60*a* and 60*b*, the viscoelastic bodies 60*a* and 60*b* can be pressed against the bottom portion 41*a* substantially evenly regardless of the size of the head portion 51, so that tight contact between the viscoelastic body 60*b* and bottom portion 41*a* can be ensured. This further improves the vibration damping effect. Due to the presence of the interposed member 70, the viscoelastic bodies 60*a* and 60*b* do not expose outside but are protected. Thus, the viscoelastic bodies 60*a* and 60*b* can be prevented from being damaged.

The fixing member 50 and interposed member 70 can also be used as members to adjust the barycentric position of the golf club head A. For example, the fixing member 50 and interposed member 70 can be made of a material having a specific gravity that is different from that of the circumferential wall of the golf club head A. When the circumferential wall of the golf club head A is made of a titanium alloy (specific gravity: about 4.5), if the fixing member 50 and interposed member 70 are made of stainless steel (specific gravity: about 7.8) or a tungsten alloy (specific gravity: about 13.0), the fixing member 50 and interposed member 70 can serve as weights as well, and the barycentric position of the golf club head A is closer to the portions of the fixing member 50 and interposed member 70. Conversely, if the fixing member 50 and interposed member 70 are made of an aluminum alloy (specific gravity: about 2.7), the barycentric position of the golf club head A is farther away from the portions of the fixing member 50 and interposed member 70.

According to this embodiment, the viscoelastic bodies 60*a* and 60*b* are fixed in the sole portion 40. However, the viscoelastic body can be fixed at different portions of the golf club head A, e.g., in the side portion 30 or crown portion 20. The viscoelastic body need not be fixed at a single portion, but a plurality of viscoelastic bodies can be fixed at a plurality of portions.

Figure 3A:
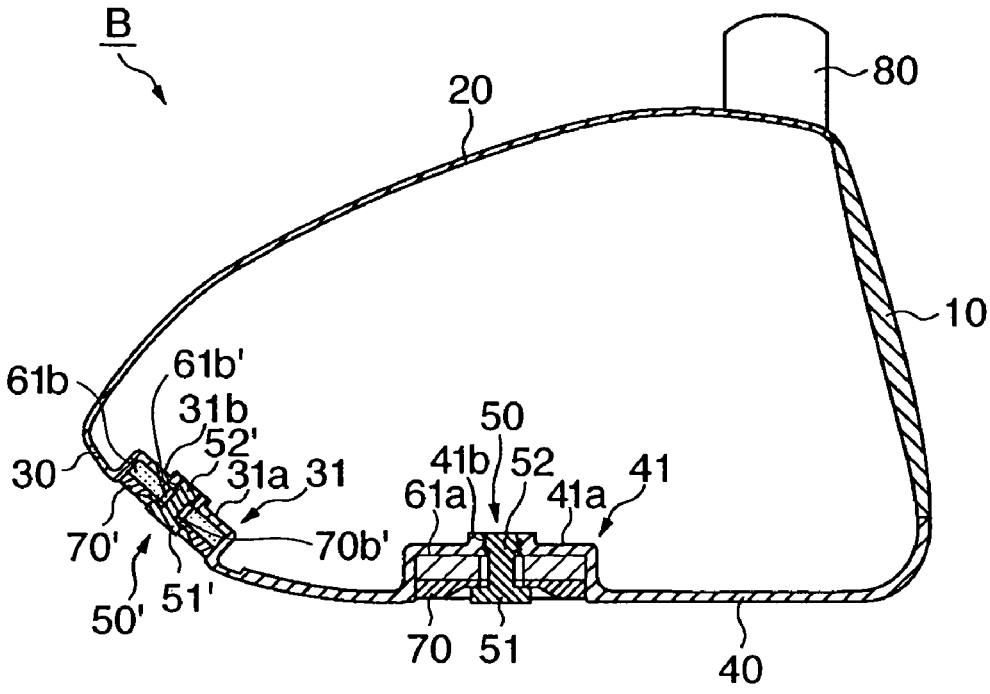
FIG. 3A is a sectional view showing the structure of a golf club head B according to another embodiment of the present invention.
Figure 3B:
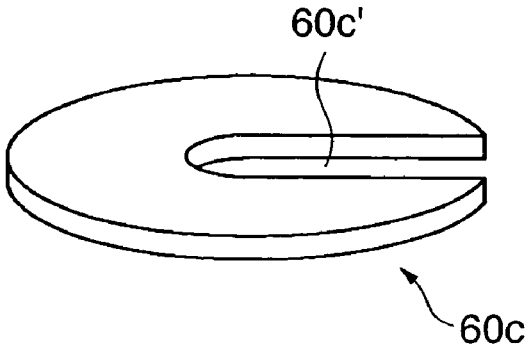
FIG. 3B is a view showing an example of the viscoelastic body.

FIG. 3A is a sectional view showing the structure of a golf club head B in which a plurality of viscoelastic bodies are fixed at a plurality of portions. In FIG. 3A, the same members as those of the golf club head A are denoted by the same reference numerals, and a description thereof will be omitted. In the golf club head B, a viscoelastic body 61*a* is fixed to a sole portion 40, and a viscoelastic body 61*b* is fixed to a back-side side portion 30. The fixing structure of the viscoelastic body 61*a* is the same as that of the golf club head A described above.

The fixing structure of the viscoelastic body 61*b* is also the same as that of the golf club head A. A brief description will be made. A recess portion 31 extending into the golf club head B is integrally formed in the back-side side portion 30, and the viscoelastic body 61*b* is disposed in the recess portion 31. A screw hole 31*b* is formed in a bottom portion 31*a* of the recess portion 31. A fixing member 50' similar to a fixing member 50 threadably engages with the screw hole 31*b*. The fixing member 50' and an interposed member 70' which is similar to an interposed member 70 fix the viscoelastic body 61*b*. The fixing member 50' has a shaft body 52' formed with a threaded portion at its one end to threadably engage with the screw hole 31*b*, and a head portion 51' integrally connected to the other end of the shaft body 52'.

The shaft body 52' of the fixing member 50' is inserted in openings 70*b*' and 61*b*' of the interposed member 70' and viscoelastic body 61*b*, respectively, and the threaded portion at the distal end of the shaft body 52' is threadably engaged with the screw hole 31*b*. Thus, the viscoelastic body 61*b* is fixed as it is sandwiched between the head portion 51' and bottom portion 31*a*.

The two viscoelastic bodies 61*a* and 61*b* desirably have vibration damping performances different from each other. With this structure, separate vibration damping effects can be enhanced for the vibration occurring in the sole portion 40 and that in the side portion 30.

In the golf club head B, as the viscoelastic body 61*b* and its fixing structure are disposed in the back-side side portion 30, the back side of the golf club head B becomes heavy to deepen the center of gravity. As the viscoelastic body 61*a* and its fixing structure are disposed in the sole portion 40, the sole portion 40 side of the golf club head B becomes heavy to lower the center of gravity. Therefore, with the golf club head B, in addition to the vibration damping effect, the center of gravity can be lowered and deepened. The materials of the respective fixing members 50 and 50' and interposed members 70 and 70' of the two sets of the fixing structures may be the same or different. If the materials of the respective fixing members 50 and 50' and interposed members 70 and 70' are different, the barycentric position described above can be adjusted.

As many apparently widely different embodiments of the present invention can be made without departing from the spirit and scope thereof, it is to be understood that the invention is not limited to the specific embodiments thereof except as defined in the appended claims.

This application claims the benefit of Japanese Patent Application No. 2005-351283 filed on Dec. 5, 2005, which is hereby incorporated by reference herein in its entirety.

What is claimed is:

1. A hollow golf club head comprising:

a fixing member having a shaft body formed with a threaded portion at one end, and a head portion at the other end of said shaft body;

a viscoelastic body being flat and having a first opening through which said shaft body extends;

a recess portion formed in a circumferential wall of the golf club head and in which said viscoelastic body is disposed, said recess portion having a bottom portion which is in contact with one surface of said viscoelastic body;

a screw hole formed in said bottom portion and threadably engages with said threaded portion, and an interposed member interposed between said viscoelastic body and said head portion and includes a second opening through which said shaft body extends, said interposed member covering the whole viscoelastic body and having a flat surface being in contact with the other surface of said viscoelastic body, wherein said viscoelastic body is fixed between said interposed member and said bottom portion by threadably engaging said threaded portion with said screw hole.

a plurality of said viscoelastic bodies having different vibration damping performances are fixed between said interposed member and said bottom portion and said interposed member includes a thin-walled portion in which said head portion is partly buried and said flat surface is the same shape as said viscoelastic body.

2. The head according to claim 1, wherein said recess portion is formed in a back-side side portion of the golf club head.

3. The head according to claim 1, wherein said head comprises one of a wood type golf club head and utility type golf club head.

4. The head according to claim 1, wherein a plurality of said recess portions are formed in different portions in the circumferential wall, and said fixing member, said viscoelastic bodies, said screw hole and said interposed member are provided to each of said recess portions.

5. The head according to claim 1, wherein each of said viscoelastic bodies is formed by mixing a metal powder and a viscoelastic material.

6. The head according to claim 1, wherein the plurality of said viscoelastic bodies are fixed in said recess portion in a stacked manner.

7. A hollow golf club head comprising:

a fixing member having a shaft body formed with a threaded portion at one end, and a head portion at the other end of said shaft body;

a viscoelastic body being flat and having a first opening through which said shaft body extends;

a recess portion formed in a circumferential wall of the golf club head and in which said viscoelastic body is disposed. said recess portion having a bottom portion which is in contact with one surface of said viscoelastic body;

a screw hole formed in said bottom portion and threadably engages with said threaded portion, and an interposed member interposed between said viscoelastic body and said head portion and includes a second opening through which said shaft body extends, said interposed member covering the whole viscoelastic body and having a flat surface being in contact with the other surface of said viscoelastic body, wherein said viscoelastic body is fixed between said interposed member and said bottom portion by threadably engaging said threaded portion with said screw hole, a plurality of said viscoelastic bodies having different vibration damping performances are fixed between said interposed member and said bottom portion, and said recess portion is formed in a sole portion of the golf club head.

8. A hollow golf club head comprising:

a fixing member having a shaft body and a head portion at one end of said shaft body;

a viscoelastic body being flat and having a first opening through which said shaft body extends;

a recess portion formed in a circumferential wall of the golf club head and in which said viscoelastic body is disposed, said recess portion having a bottom portion which is in contact with one surface of said viscoelastic body;

an engaging portion formed in said bottom portion and engages with the other end of said shaft body; and an interposed member interposed between said viscoelastic body and said head portion and includes a second opening through which said shaft body extends, said interposed member covering the whole viscoelastic body and having a flat surface being in contact with the other surface of said viscoelastic body, wherein said viscoelastic body is fixed between said interposed member and said bottom portion by engaging the other end of said shaft body with said engaging portion, and a plurality of said viscoelastic bodies having different vibration damping performances are fixed between said interposed member and said bottom portion, and said interposed member includes a thin-walled portion in which said head portion is partly buried and said flat surface is the same shape as said viscoelastic body.

9. A hollow golf club head comprising:

a fixing member having a shaft body and a head portion at one end of said shaft body: a viscoelastic body being flat and having a first opening through which said shaft body extends;

a recess portion formed in a circumferential wall of the golf club head and in which said viscoelastic body is disposed, said recess portion having a bottom portion which is in contact with one surface of said viscoelastic body;

an engaging portion formed in said bottom portion and engages with the other end of said shaft body, and an interposed member interposed between said viscoelastic body and said head portion and includes a second opening through which said shaft body extends, said interposed member covering the whole viscoelastic body and having a flat surface being in contact with the other surface of said viscoelastic body, wherein said viscoelastic body is fixed between said interposed member and said bottom portion by engaging the other end of said shaft body with said engaging portion.

a plurality of said viscoelastic bodies having different vibration damping performances are fixed between said interposed member and said bottom portion, and said recess portion is formed in a sole portion of the golf club head.

10. The head according to claim 8, wherein said recess portion is formed in a back-side side portion of the golf club head.

11. The head according to claim 8, wherein said head comprises one of a wood type golf club head and utility type golf club head.

12. The head according to claim 8, wherein a plurality of said recess portions are formed in different portions in the circumferential wall, and p1 said fixing member, said viscoelastic bodies, said screw hole and said interposed member are provided to each of said recess portions.

13. The head according to claim 8, wherein each of said viscoelastic bodies is formed by mixing a metal powder and a viscoelastic material.

14. The head according to claim 8, wherein the plurality of said viscoelastic bodies are fixed in said recess portion in a stacked manner.

15. The head according to claim 7, wherein said head comprises one of a wood type golf club head and utility type golf club head.

16. The head according to claim 7, wherein each of said viscoelastic bodies is formed by mixing a metal powder and a viscoelastic material.

17. The head according to claim 7, wherein the plurality of said viscoelastic bodies are fixed in said recess portion in a stacked manner.

18. The head according to claim 9, wherein said head comprises one of a wood type golf club head and utility type golf club head.

19. The head according to claim 9, wherein each of said viscoelastic bodies is formed by mixing a metal powder and a viscoelastic material.

20. The head according to claim 9, wherein the plurality of said viscoelastic bodies are fixed in said portion in a stacked manner.

* * * * *